United States Patent [19]

Dreizler et al.

[11] Patent Number: 5,015,174

[45] Date of Patent: May 14, 1991

[54] BURNER HEAD FOR A FORCED-AIR GAS BURNER

[76] Inventors: Walter Dreizler, Brachetweg 16, 7000 Stuttgart 75; Ulrich Dreizler, Verenaweg 3, 7208 Spaichingen, both of Fed. Rep. of Germany

[21] Appl. No.: 369,446

[22] Filed: Jun. 21, 1989

[30] Foreign Application Priority Data

Jun. 21, 1988 [DE] Fed. Rep. of Germany ..... 3820849

[51] Int. Cl.[5] ..... F23C 7/00

[52] U.S. Cl. ..... 431/116; 431/351; 431/115

[58] Field of Search ..... 431/116, 115, 351

[56] References Cited

U.S. PATENT DOCUMENTS 2,518,937 8/1950 Roberts ..... 431/116

3,663,153 5/1972 Bagge et al. ..... 431/351

*Primary Examiner*—Larry Jones

*Attorney, Agent, or Firm*—Edwin E. Greigg

[57] ABSTRACT

A burner head for a forced-air gas burner having a combustible gas distributor and a combustion air distributor, having radially disposed combustible gas nozzles and axially extending combustion air flow openings, in which the flame root is formed in the vicinity of the nozzles and flow openings, with ribs protruding radially into the flame region downstream of the flame root. A flame tube is provided coaxially with the burner tube, and an annular gap is provided for exhaust gas recirculation between the burner tube and the flame tube.

25 Claims, 3 Drawing Sheets

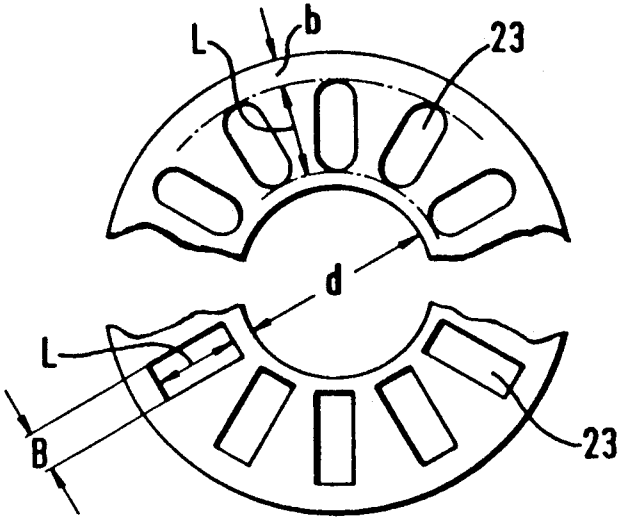
Fig. 9
Fig. 10
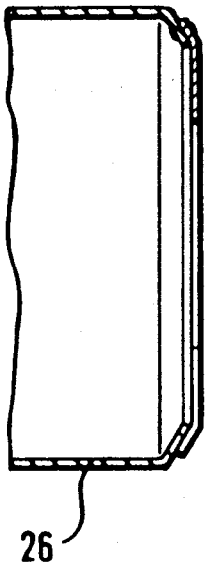
Fig. 8
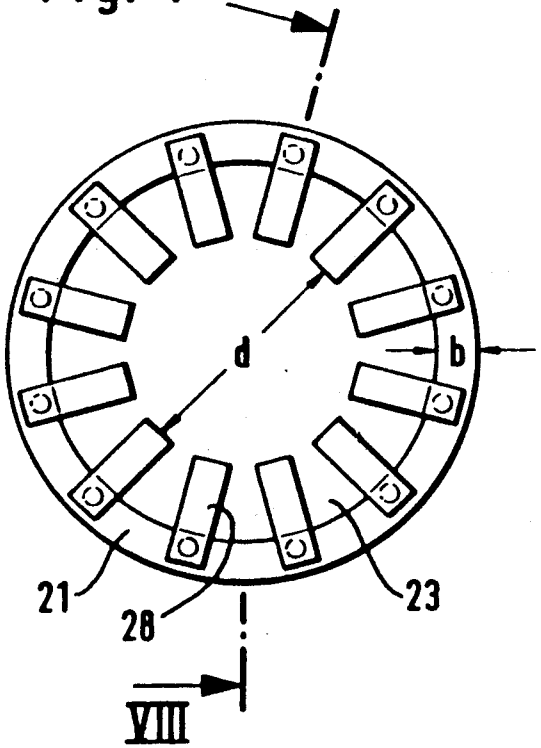
Fig. 7

BURNER HEAD FOR A FORCED-AIR GAS BURNER

BACKGROUND OF THE INVENTION

The invention is based on a burner head for a forced-air gas burner as defined herein. In a known forced-air gas burner of this type (French Patent 1 507 416), the fundamental problems of this type of gas burner are apparent. Since the gas is supplied to the combustion chamber at relatively low pressure, in order to effect homogeneous mixing with the combustion air the gas supply must be fanned out and suitably mixed as homogeneously as possible with the supplied combustion air. There is also the danger in such forced-air gas burners that the flame will separate, which then reignites automatically, which can lead to an unpleasant pulsation. In this known forced-air gas burner, a baffle ring disposed inside the burner tube is intended to stabilize the flame.

The high temperatures, especially when natural gas is burned, result in a high proportion of nitrogen oxide ($NO_x$) in the exhaust gas, despite the otherwise excellent, and in particular soot-free, combustion. The level of this nitrogen oxide component is above the allowable threshold value, so a reduction is necessary. Such a reduction could be attained by increasing the proportion of air and thus lowering the flame temperature, but that would have the disadvantage of poorer quality combustion.

In forced-air oil burners, it has been set forth heretofor in an (International Application WO 86/07434) to improve the proportion of toxic substances, especially nitrogen oxides, in the final exhaust gas by recirculating the exhaust gas first. To do so, recirculation openings are provided between the burner tube and the flame tube having a somewhat larger diameter, forming a cooler jacket of recirculated exhaust gases around the flame; because of the high turbulence, at least some of this exhaust gas then mixes with the oil-and-air mixture to be burned, or penetrates the burning flame. Unlike the forced-air gas burner, though, in the oil burner a conical oil spray having a high amount of hydraulic energy is available, generated by the oil burner nozzle. The combustion air is blown into this conical spray at likewise high air pressure and with a spin, to attain the sufficiently good mixing of the oil mist and the combustion air required for good combustion. Despite the spin and the baffle plates in the flame tube, this intrinsically lends a high speed to the combustible gas, which effects the recirculation via the radial openings between the burner tube and the flame tube. Nevertheless, in this known forced-air oil burner, the flame tube is flared on the side toward the burner tube, downstream of the recirculation openings, in order to superimpose a funnel effect on the existing venturi effect.

The situation is quite different with forced-air gas burners, because of their intrinsically low gas pressure. A recirculation of the above kind above would not be possible, since the air speeds in the flame tube are much too low; such radial openings, intrinsically serving to provide recirculation, could allow the flame to exit radially. Uncontrollable pulsations effected by such "false air openings" would occur, which not only could generate considerable noise, but also would not meet safety regulations, which as is well known are quite stringent in the field of forced-air gas burners.

OBJECT AND SUMMARY OF THE INVENTION

The object of the invention is to develop a burner head for forced-air gas burners with which the proportion of $NO_x$ in the finally exhausted gas can be reduced to a level that if at all possible is below 50 ppm of $NO_x$. This object is attained by means of the burner head according to the invention, as defined herein.

This burner head according to the invention has an advantage over known forced-air gas burners that in a very simple manner, and without increasing the pressure of the combustible gas or of the combustion air supplied, and by exploiting the effect, known per se, of exhaust gas recirculation, a substantial reduction in the $NO_x$ component is possible, namely to below 50 ppm. Advantageously, the diameter of the burner tube and of the flame tube can be kept virtually equal, even though at these low speeds of the gas/air flow with effective exhaust gas recirculation, low $NO_x$ values, reduced CO values and high burner output with simultaneously high flame stability are attainable.

The ribs exposed to the oncoming flame can be embodied in various ways. The definitive factor is that the hot flow undergoes damming, with an overpressure zone upstream and a negative pressure zone downstream of the rib, the first effecting a flame stabilization and the second initiating the recirculation of the exhaust gas.

In an advantageous feature of the invention, the device for distributing the combustible gas, in the manner of a crosscurrent burner, has a burner ring and burner plate disposed crosswise to the burner head axis, with radially arranged combustible gas nozzles and axially provided flow openings for the combustion air. As a result, so-called toroidal vortices develop downstream of the burner ring, as well as flame zones near the combustible gas nozzles, with combustion taking place with an air deficiency, and flame zones near the flow openings with combustion with an air excess, even though intensive mixing of the streams of gas emerging from the combustible gas nozzles with the rotating combustion air does occur. These flame zones form the burner flame root, which for a second combustion stage is propagated downstream of the ribs in the flame tube.

In a further advantageous feature of the invention, the peripheral region of the burner ring toward the burner tube has additional openings for the combustion air in the form of recesses, embodied as indentations next to an annular gap. These indentations, which in a feature of the invention are spaced apart from one another by approximately one-fourth to one-third of the spacing between the individual combustible gas nozzles in the outer row, oriented toward the indentations, of the burner ring, effect a change and in particular an increase in the air speed and hence an intensification of the toroidal vortices, which improves the mixing of the combustible gas with the combustion air.

In another advantageous feature of the invention, a vortex disk for combustion air is disposed in the burner tube, downstream of the device for distributing the combustible gas. By means of this vortex disk, which in a known manner has segments positioned obliquely against one another and which is also known as a swirl disk, a helical swirling motion is imparted to the combustion air. The primary advantage here is that the combustion air is forced to spend a longer time on its way to the flame root, in addition to the fact that substantially better mixing between the combustible gas and the combustion air is effected. In combination with the increased air speed effected by the indentations, this swirling effect of the combustion air continues through the indentations until reaching the ribs, and promotes the columnar vortex, forming in the flame tube because of the ribs, by which vortex the exhaust gas recirculation is effected. Known swirl disks are always disposed downstream of the combustible gas nozzles or air outlet openings, and correspondingly have a different effect.

In further features of the invention, the ribs are disposed on a ribbed ring, which may be embodied quite variously. For instance, the ribs on the inside may be interconnected by a ring, resulting in a kind of perforated disk.

The invention will be better understood and further objects and advantages thereof will become more apparent from the ensuing detailed description of a preferred embodiment and several variants, taken in conjunction with the drawings.

BRIEF DESCRIPTION OF THE DRAWINGS

FIG. 7 shows a plan view of a further variant embodiment of the ribs;

FIG. 8 is a section taken through the variant of FIG. 7 along the line VIII—VIII of FIG. 7; and FIGS. 9 and 10 are fragmentary plan views showing two variants of the ribbed disk in the form of perforated disks.

DESCRIPTION OF THE PREFERRED EMBODIMENT

Figure 1:
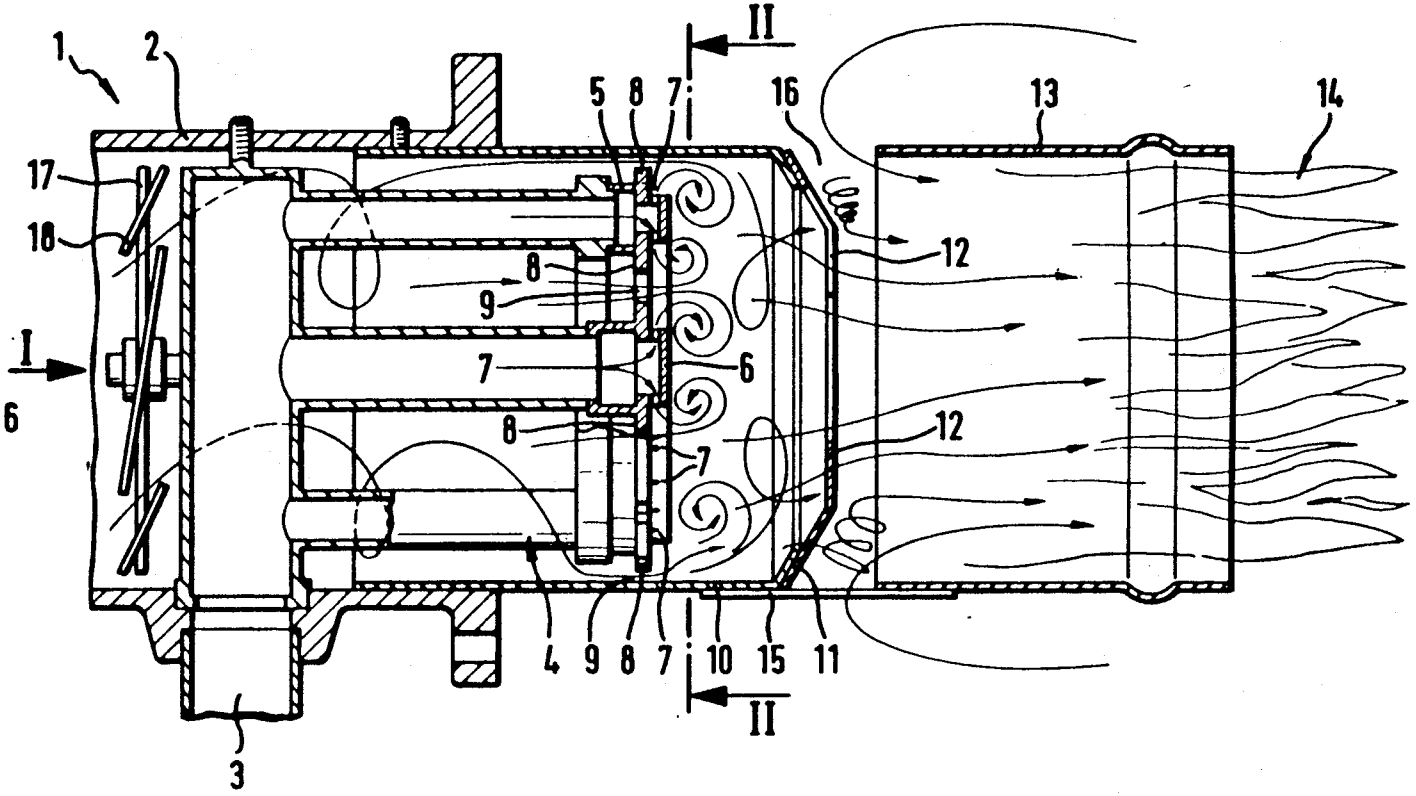
FIG. 1 shows the burner head in longitudinal section.

For the burner head 1 shown in FIG. 1 of a forced-air gas burner, the actual combustion air blower with its motor and fan wheel is not shown; the drawing shows only the part 2 of the gas burner housing pertaining to the burner head, or in other words the part that is directly connected to the boiler and the combustion chamber. The combustion air is supplied to the burner head 1 via the burner housing, the remainder of which is not shown, in the direction of the arrow I. The combustible gas is supplied to the burner head radially via a gas line 3 and is carried on inside the burner head via a tubular distributor device 4. The tubular distributor device 4 is closed off in the direction toward the combustion chamber by a burner ring 5 and a burner plate 6. Between the burner plate 6 and the burner ring 5, there are radial combustible gas nozzles 7 to provide an exit for the combustible gas crosswise to the burner head axis. Edges 8 of air flow openings 9 are present on the burner ring 5, on the sides exposed to the oncoming combustion air. These edges 8 generate so-called toroidal vortices, into which the streams of combustible gas exiting from the combustible gas nozzles 7 are aspirated and intensively mixed with the rotating combustion air. In this region of the vortices indicated in FIG. 1 downstream of the burner ring, the flame roots of a short burner flame begin, without additional baffle plates being required to generate them. One of the air flow openings 9 is formed by the annular gap between the burner ring 5 and a burner tube 10, which is inserted radially sealingly into the housing 2 of the gas burner and secured on it, fitted over the burner ring 5 and the tubular distributor device 4.

Secured to the end of the burner tube 10 toward the combustion chamber is a ribbed ring 11, which has ribs 12 protruding radially inward into the flame. A flame tube 13 having the same diameter as the burner tube 10 is secured on it, spaced apart from the burner tube 10, surrounding the first part of the burner flame 14; except where fastening brackets 15 are disposed, the result is an annular gap 16 between the burner tube 10 and the flame tube 13, through which exhaust gases from the boiler combustion chamber can recirculate into the flame tube again.

The ribbed ring 11 having the ribs 12 effects a slight constriction of the mass flame flow flowing past it, slightly accelerating the flow speed while at the same time deflecting it slightly inward radially, so that at the ribs 12, "columnar" vortices form, which lead to the aspiration of the exhaust gases from the annular gap 16 and thus to the recirculation of the exhaust gases; these vortices are moreover reinforced by the injector effect of the mass flame flow in the flame tube 13. By means of the ribbed ring 11, some of the cool combustion air flowing into the air flow openings 9 at the wall of the burner tube 10 is also carried into the flame center; as a result, because the recirculating exhaust gases are lower in oxygen and have cooled down slightly in the meantime, a lowering of the flame temperatures is attained, with the corresponding reduction of the $NO_x$ proportion to below 40 ppm.

A vortex disk 17 is disposed in the burner head 1 upstream of the distributor device 4, having virtually the same diameter as the burner tube 10; its segments 18 are positioned obliquely with respect to one another and generate a helical swirling motion of the combustion air.

Figure 2:
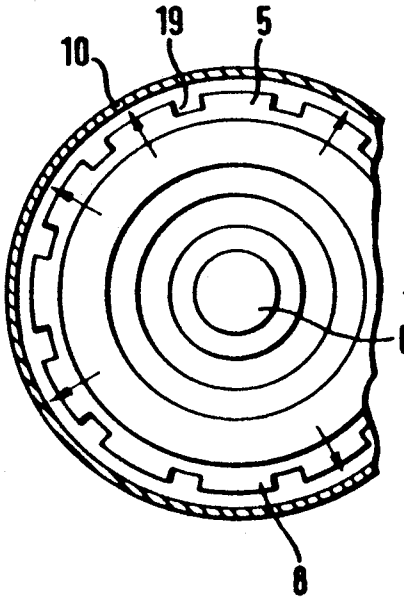
FIG. 2 is a fragmentary section taken along the line II—II of FIG. 1.

As FIG. 2 shows, indentations 19 are provided in the peripheral region of the burner ring 5 that intermittently enlarge the air flow openings 9 and have a corresponding influence on the speed of the flow of combustion air; in combination with the swirl of the air flow effected by the vortex disk, these indentations effect an improvement in the toroidal vortices and in the preparation of the mixture of combustible gas and combustion air.

Figure 3:
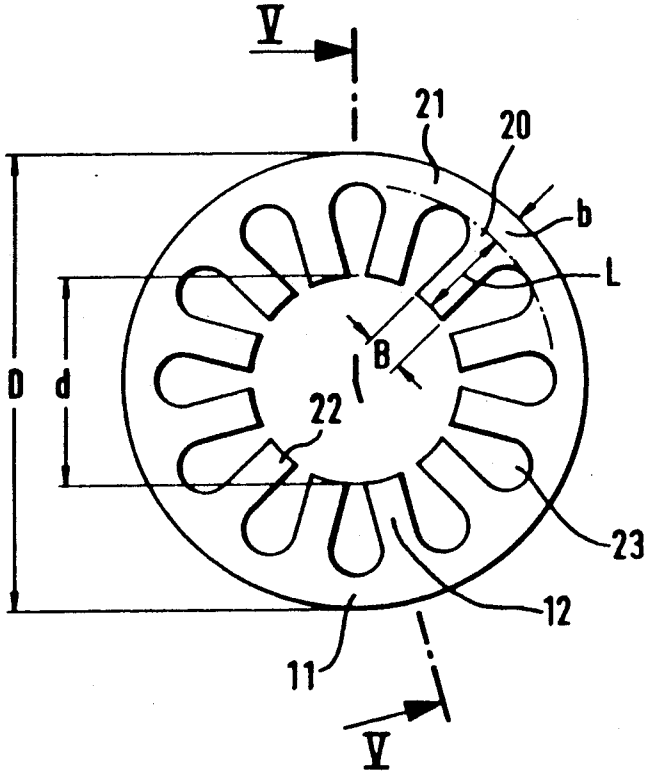
FIG. 3 is a plan view of the ribbed disk of the exemplary embodiment.

In the ribbed ring 11 having ribs 12 as shown in plan view in FIG. 3, a free inside opening having a diameter d remains between the free ends 22 of the ribs 12; this diameter is at a predetermined ratio to the outside diameter D and to the annular width b of the outer, unperforated portion 21 of the ribbed ring. The ribs 12 are embodied as sheet-metal lugs of width B, with their rib base 20 distributed uniformly and in a flat surface on the outer annular portion 21 of the ribbed ring 11 and merged in rounded fashion with the portion 21. The length of the ribs between the free ends 22 up to the rib base is indicated at L. By this arrangement, the flow openings 23 of the ribbed ring 11 between the ribs 12 have a teardrop-shaped cross section, which increases as it extends radially outward and is open toward the inside diameter of the ribbed ring 11.

Figure 6:
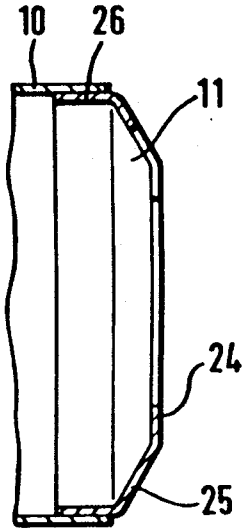
FIGS. 5 and 6 are each a sectional view taken along the line V—V of FIG. 3, each for one of two variants.
Figure 5:
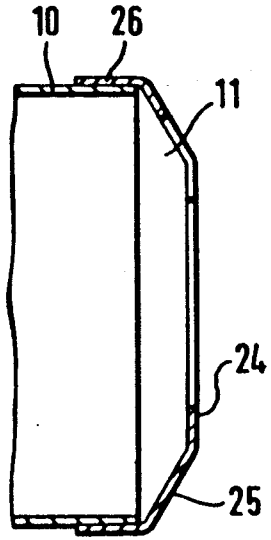

In each of FIGS. 5 and 6, sectional views through the ribbed ring 11 along the line V—V are shown, and it can be seen that the ribs 12 have a break in their longitudinal course, so that they have one end portion 24 extending at right angles to the burner head axis and one base portion 25 extending obliquely with respect to the burner head axis. The base portion 25 merges with the conical outer annular portion 21, which is adjoined by a cylindrical tube portion 26 with which the ribbed ring 11 is fitted onto the burner tube 10. In the variant shown in FIG. 5, this tubular portion 26 is larger in diameter than the burner tube 10 and so is fitted over it, while contrarily in the variant of FIG. 6, the tubular portion 26 is smaller in diameter than the burner tube 10 and thus is fitted into the burner tube 10 and secured to it. For the desired exhaust gas recirculation while simultaneously having favorable combustion, the factors playing a definitive role are the ratio of the various dimensions D, d, L, B, b; the inclination of the base portion 25; and the inclination of the outer annular portion 21.

Figure 4:
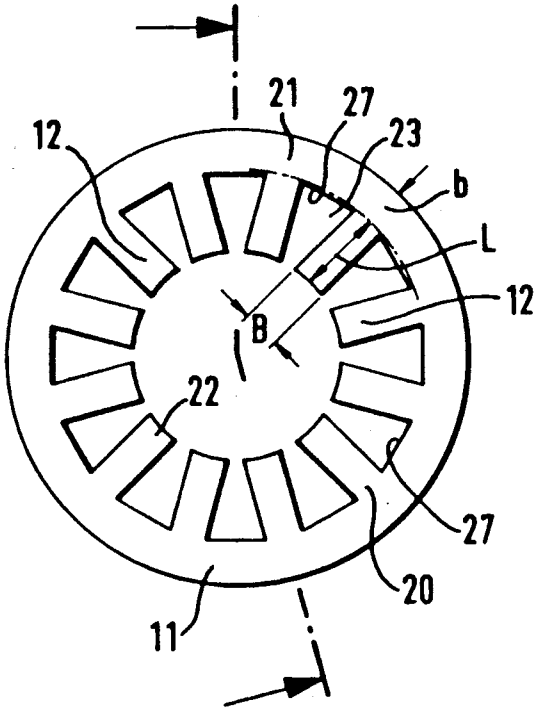
FIG. 4 is a plan view of a variant of this ribbed disk.

In the variant of the ribbed ring 11 having ribs 12 shown in FIG. 4, the lateral limitations of the ribs 12 in the form of sheet-metal lugs are embodied as parallel as far as the rib base 20; the base edges 27 of the flow openings 23, by which the rib bases 20 are joined together, are also rectilinear, so that in this variant the cross section of the flow openings 23 is in the form of a trapezoid open at the top.

Another variant of the ribbed ring 11 is shown in FIGS. 7 and 8; once again the ribbed ring is in a single piece, embodied by the tubular portion 26 and the outer, unperforated annular portion 21, and sheet-metal tabs 28, secured to the ribbed ring for instance by spot welding or riveting, protrude inward in a star-like pattern. The remaining flow cross section of the flow openings 23 thus formed is equivalent to that in the variant shown in FIG. 4.

Another embodiment of the ribbed ring 11 is shown in FIGS. 9 and 10, in which the ribbed ring is embodied as a perforated plate, having oval flow openings 23 in FIG. 9, and rectangular flow openings 23 in FIG. 10.

The burner head according to the invention functions as follows:

To the combustible gas emerging via the combustible gas nozzles 7 extending radially inward and outward from the burner ring 5, combustion air is supplied and mixed with it via the air flow openings 9 and the indentations 19, so that at the flame root, or in other words upstream of the ribbed ring, mixtures of variable gas concentration are available for combustion. While near the air flow openings 9 and indentations 19, combustion proceeds with a very high air excess, the combustion in the vicinity of the combustible gas nozzles 7 takes place with a deficiency of air. In both cases, the combustion temperature therefore remains low, resulting in very low emissions of $NO_x$ in these portions of the flame. Only in the ensuing flame tube 13 does the final, complete combustion taken place, with the desired reduction in the proportion of CO in the exhaust gas. Since the combustion air is additionally swirled via the vortex disk 17, an intensification of the mixing of the gas/air mixture, which on side side is overly lean and on the other is overly rich, takes place, so that combustion that is still sufficient for the intended purpose is attained upstream of the ribbed ring 11. Because of the indentations 19, the flame, swirled via the vortex disk 17, strikes the ribbed ring 11 having the ribs 12 in the manner of air pulses, which creates an overpressure zone upstream of the ribbed ring on its surfaces facing into the oncoming flow; the overpressure zone is followed on the downstream side by a negative pressure zone. This negative pressure zone, which in accordance with the embodiment of the ribbed rings 11 is open toward the annular gap 16, pulls the exhaust gases surrounding the burner tube 10 and the flame tube 13 inward as shown by the curved arrows, so that a desired exhaust gas recirculation is brought about. The exhaust gas is thus steered into the flame by the interstices formed by the ribs 12 and has the effect of lowering the flame temperature and thus reducing the proportion of $NO_x$. The proportion of CO in the exhaust gas is also reduced, quite aside from the fact that the ribbed ring 11 has the desirable effect in forced-air gas burners of anchoring the flame, or in other words preventing separation of the flame. Finally, with this two-stage combustion with exhaust gas recirculation, there is the advantage that a forced-air gas burner with the burner head according to the invention is usable largely regardless of the fire box design.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A burner head for a forced-air gas burner that includes a burner tube, a combustible gas inlet, said burner tube receives a device (4), said device (4) includes a plurality of tubes that join said combustible gas inlet for distributing combustible gas and combustion air, said device for distributing gas and combustion air including combustible gas nozzles (7) and air flow openings (9, 19), a flame tube (13) adjoining the burner tube (1), at least one radial opening (16) between an end of said burner tube (10) and an adjacent end of said flame tube (13), which serves to provide exhaust gas recirculation, a ribbed ring (11) secured between the burner tube (10) and the flame tube (13) upstream of said radial opening (16) but downstream of said combustible gas nozzles (7) and air flow openings (9, 19), and said ribbed ring includes ribs (12) which protrude radially inward, crosswise to the longitudinal axis of the burner head.

2. A burner head as defined by claim 1, in that in the manner of a cross current burner, said device (4) for distributing the combustible gas and combustion air includes a burner ring (5) and a burner plate (6) disposed crosswise to the burner head axis said burner ring (5) and said burner plate (6) include gas nozzles (7) which are radially disposed, and which direct gases into axially provided air flow openings (9).

3. A burner head as defined by claim 2, in which a vortex disk (17) for the combustion air is disposed in the burner tube (10) upstream of said device (4) for distributing the combustible gas and combustion air.

4. A burner head as defined by claim 2, in which said ribs (12) are disposed as baffle faces in the direction of the combustion air flowing through said flow openings (9).

5. A burner head as defined by claim 2, in which said ribbed ring (11), includes a central opening and an outer, unperforated annular portion (21) having flow openings (23) of a predetermined cross section between said ribs (12) and said annular portion (21).

6. A burner head as defined by claim 5, in which said ribbed ring (11) is limited radially on its outside by a cylindrical tubular portion (26), which is equivalent to the diameter of the burner tube (10) and is secured to said burner tube.

7. A burner head as defined by claim 2, in which the radial limiting edges of said ribs (12) extend parallel to one another, and the rib length (L) is at least twice as long as the rib width (B).

8. A burner head as defined by claim 2, in which said burner ring (5) includes recesses in the peripheral region of the burner ring (5) toward the burner tube (10) embodied in the form of indentations (19) juxtaposed an annular gap, as additional air outlet openings for the combustion air.

9. A burner head as defined by claim 6, in which a vortex disk (17) for the combustion air is disposed in the burner tube (10) upstream of said device (4) for distributing the combustible gas and combustion air.

10. A burner head as defined by claim 8, in which said indentations (19) are spaced apart circumferentially from about one-fourth to one-third of the spacing between the combustible gap nozzles (7) and oriented radially toward the indentations (19) of the burner ring (5).

11. A burner head as defined by claim 10, in which a vortex disk (17) for the combustion air is disposed in the burner tube (10) upstream of said device (4) for distributing the combustible gas and combustion air.

12. A burner head as defined by claim 1, in which a vortex disk (17) for the combustion air is disposed in the burner tube (10) upstream of said device (4) for distributing the combustible gas and combustion air.

13. A burner head as defined by claim 1, in which said ribs (12) are disposed as baffle faces in the direction of the combustion air flowing through said flow openings (9).

14. A burner head as defined by claim 1, in which said ribbed ring (11), includes a central opening and an outer, unperforated annular portion (21) having flow openings (23) of a predetermined cross section between said ribs (12) and said annular portion (21).

15. A burner head as defined by claim 14, in which said ribbed ring (11) is limited radially on its outside by a cylindrical tubular portion (26), which is equivalent to the diameter of the burner tube (10) and is secured to said burner tube.

16. A burner head as defined by claim 15, in which the radial limiting edges of said ribs (12) extend parallel to one another, and the rib length (L) is at least twice as long as the rib width (B).

17. A burner head as defined by claim 15, in which said flow openings (23) of the ribbed ring (11) are open toward an inside opening of the ribbed ring.

18. A burner head as defined by claim 15, in which said ribs are embodied as sheet-metal tabs (28), which are secured to the outer, unperforated portion (21).

19. A burner head as defined by claim 15, in which said outer, unperforated annular portion (21) of the ribbed ring (11) has a conical portion inclined in a fluid flow control direction.

20. A burner head as defined by claim 14, in which the radial limiting edges of said ribs (12) extend parallel to one another, and the rib length (L) is at least twice as long as the rib width (B).

21. A burner head as defined by claim 20, in which said ribs (12) widen in rounded fashion toward the rib base (20), and that radially inwardly the ribs have free ends (22), so that the cross section of the flow openings (23) is teardrop-shaped.

22. A burner head as defined by claim 20, in which said flow openings (23) in the ribbed ring (11) have a trapezoidal, rectangular or oblong-slot-like cross section.

23. A burner head as defined by claim 14, in which said ribs are embodied as sheet-metal tabs (28), which are secured to the outer, unperforated portion (21).

24. A burner head as defined by claim 14, in which said outer, unperforated annular portion (21) of the ribbed ring (11) has a conical portion inclined in a fluid flow control direction.

25. A burner head as defined by claim 24, in which at least one base portion (25) of the ribs (12) has the same inclination as the outer annular portion.

* * * * *